US008494414B2

(12) United States Patent
Taniguchi

(10) Patent No.: US 8,494,414 B2
(45) Date of Patent: Jul. 23, 2013

(54) DRIVING DEVICE AND IMAGE FORMING APPARATUS

(75) Inventor: Koichi Taniguchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 524 days.

(21) Appl. No.: 12/839,634

(22) Filed: Jul. 20, 2010

(65) Prior Publication Data

US 2011/0017003 A1 Jan. 27, 2011

(30) Foreign Application Priority Data

Jul. 23, 2009 (JP) ..... 2009-172472

(51) Int. Cl.
*G03G 15/00* (2006.01)

(52) U.S. Cl.
USPC ..... 399/167

(58) Field of Classification Search
USPC ..... 399/167, 159
See application file for complete search history.

(56) References Cited

U.S. PATENT DOCUMENTS

| | | | | |
|---|---|---|---|---|
| 2007/0231009 | A1* | 10/2007 | Watahiki | 399/167 |
| 2007/0248383 | A1* | 10/2007 | Ueda et al. | 399/167 |
| 2009/0120763 | A1* | 5/2009 | Takuroh et al. | 198/341.08 |

FOREIGN PATENT DOCUMENTS

| | | |
|---|---|---|
| CN | 1410842 A | 4/2003 |
| JP | 6-308784 | 11/1994 |
| JP | 2000-231301 | 8/2000 |
| JP | 2000-249190 | 9/2000 |
| JP | 2005-91609 | 4/2005 |
| JP | 2005-180560 | 7/2005 |

OTHER PUBLICATIONS

1 Notification of the First Office Action, dated Nov. 15, 2012, by the State Intellectual Property Office of the People's Republic of China, issued in counterpart Chinese Application No. 201010237402.5.

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

A drive device has a drive source; a rotatable member gear rotated by a driving force from the driving source; a follower gear, including a pair of gears which are coaxially disposed with each other and are rotatable at the same rotational speed and including an urging device for urging the pair of gears in rotational directions opposite from each other, for being rotated at the rotational speed higher than that of the rotatable member gear; a rotation detecting device for detecting rotation of the follower gear and including a flag rotatable together with said follower gear and provided coaxially with said follower gear and includes a detecting portion for detecting passing of the flag; and a driving source control portion for controlling said driving source on the basis of the computation result stored in the storing portion.

6 Claims, 9 Drawing Sheets

(a)

(b)

(a)

(b)

DRIVING DEVICE AND IMAGE FORMING APPARATUS

FIELD OF THE INVENTION AND RELATED ART

The present invention relates to a driving device using gears and an image forming apparatus, including the driving device, such as a copying machine, a facsimile machine, a printer, a multi-function machine or a printing machine.

In a conventional image forming apparatus employing an electrophotographic method, image formation is effected in the following manner. First, a photosensitive member as an image bearing member is electrically charged by a charger and is subjected to irradiation with light correspondingly to image information to form a latent image. Then, this latent image is developed by a developing device to obtain a developer image (toner image), which is then transferred onto a recording material to form an image. Incidentally, there is also a structure in which the toner image formed on the photosensitive member is primary-transferred onto an intermediary transfer belt as an image bearing member and then is secondary-transferred onto the recording material. In such an image forming apparatus, rotational speed non-uniformity of the photosensitive member or the intermediary transfer belt as the image bearing member causes image defect such as image expansion and contraction. Particularly, in the case of a color image forming apparatus, deviation of the image expansion and contraction among respective colors appears as color misregistration, so that a degree of image degradation is large. Therefore, in order to improve an image quality, it is necessary to suppress the rotational speed non-uniformity of the photosensitive member or the intermediary transfer belt as small as possible.

A driving roller for driving such a photosensitive member or intermediary transfer belt is generally driven by transmitting a driving force from a motor as a driving source thereto through a speed-reducing gear train. For this reason, a principal cause of an occurrence of the above-described rotational speed non-uniformity is eccentricity of each of gears constituting such a gear train or tilting of each gear during mounting. In order to prevent the rotational speed non-uniformity, e.g., a structure in which the rotational speed of the photosensitive member was detected and controlled has been conventionally known. As the structure, e.g., a structure in which the rotational speed of a follower gear rotated at an increased speed by rotation of a photosensitive member gear which is a rotatable member gear fixed on a rotation shaft of the photosensitive member as a rotatable member was detected has been known. In the case of this structure, the rotational speed of the follower gear rotated at the increased speed is detected, so that it is possible to improve rotation accuracy even when a low-resolution rotary encoder is used (e.g., Japanese Laid-Open Patent Application (JP-A) 2005-91609).

However, in the case where the rotational speed of the follower gear is detected as described above, due to backlash present between the photosensitive member gear and the follower gear, the rotational speed detection cannot be accurately performed in some instances. Therefore, in order to eliminate the backlash, a structure in which a press-contact gear to be urged against the photosensitive member gear with respect to a rotational direction was provided and both of these gears were engaged with the follower gear has been known. In the case of this structure, a tooth of the follower gear is sandwiched between a touch of the photosensitive member gear and a tooth of the press-contact gear, so that the backlash is suppressed (e.g., JP-A 2005-180560). Incidentally, in order to prevent the rotational speed non-uniformity of the photosensitive member or the like, a structure in which a flywheel was provided on a pulley or gear for driving the rotatable member has also been conventionally known (e.g., JP-A Hei 6-308784, JP-A 2000-249190 and JP-A 2000-231301).

However, in the case where the photosensitive member gear and the follower gear are provided as in the structures described in JP-A 2005-91609 and JP-A 2005-180560, eccentricity of these (both) gears and the driving gear, fixed on the rotation shaft of the motor, for driving the photosensitive member gear influences the detection of the rotational speed. In order to eliminate the influence of the eccentricity, it can be considered that the image of the eccentricity of each of the gears is measured in advance and a measurement result is stored in a storing device and then the image of the eccentricity is cancelled when the rotation is detected. However, in this case, it is necessary to perform the measurement for cancelling the image of the eccentricity every device in advance. Particularly, in the case of using the rotary encoder for the rotational speed detection, the image of processing accuracy or mounting accuracy of the rotary encoder is required to be taken into consideration, so that preliminary measurement for cancelling the image of the eccentricity is essential. For this reason, the use of the rotary encoder cannot meet the case where the image of the eccentricity is changed from that in the preliminarily measured state due to a change with time such as consumption of respective parts.

Further, in the case of the structure described in JP-A Hei 6-308784, JP-A 2000-249190 and JP-A 2000-231301, a degree of the rotational speed non-uniformity can be decreased by providing the flywheel but when the eccentricity of the gear and the backlash as described above are taken into consideration, the degree of the rotational speed non-uniformity cannot be sufficiently decreased.

SUMMARY OF THE INVENTION

The present invention has been accomplished in view of these circumstances. A principal object of the present invention is to realize a structure in which control for decreasing a degree of rotational speed non-uniformity of a rotatable member in expensively with high accuracy by eliminating an image of eccentricity of each of gears and backlash.

A specific object of the present invention is to provide a driving device capable of effecting the control for decreasing the degree of rotational speed non-uniformity of the rotatable member inexpensively with high accuracy.

According to an aspect of the present invention, there is provided a drive device comprising:

a drive source;

a rotatable member gear, fixed on a rotation shaft of a rotatable member, for being rotated by transmitting thereto a driving force from the driving source;

a follower gear, including a pair of gears which are coaxially disposed with each other and are rotatable at the same rotational speed by rotation of the rotatable member gear and including urging means for urging the pair of gears in rotational directions opposite from each other, for being rotated at the rotational speed higher than that of the rotatable member gear;

rotation detecting means, including a single flag rotatable together with the follower gear and including a detecting portion for detecting passing of the flag, for detecting rotation of the follower gear;

a computing portion for computing rotation fluctuation of the rotatable member gear from a signal of the detecting portion;

a storing portion for storing a computation result of the computing portion; and a driving source control portion for controlling said driving source on the basis of the computation result stored in the storing portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Figure 1:
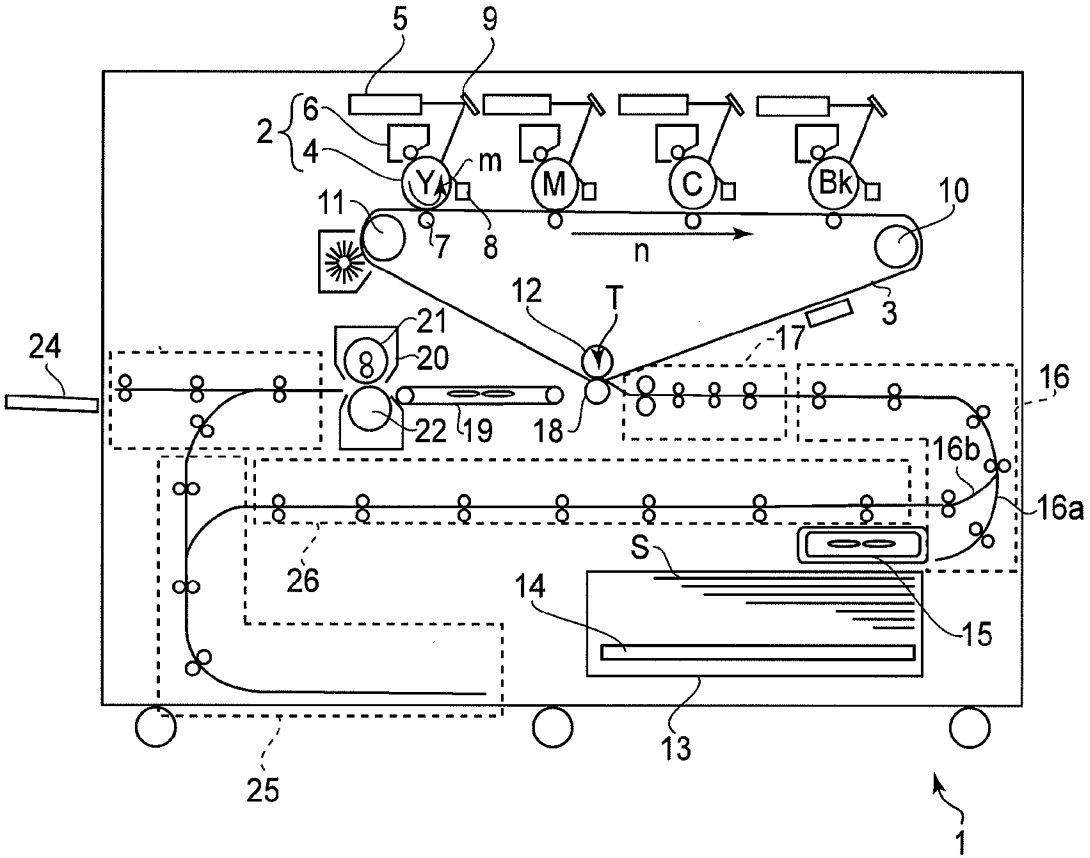
FIG. 1 is a schematic view of an image forming apparatus in First Embodiment.

First Embodiment of the present invention will be described with reference to FIGS. 1 to 8. First, an image forming apparatus in this embodiment will be described with reference to FIG. 1. Incidentally, as the image forming apparatus to which the present invention is applicable, in addition to an electrophotographic image forming apparatus, those of a plurality of types including, e.g., an offset print type, an ink jet type, and the like. Of these types, an image forming apparatus 1 shown in FIG. 1 is a color image forming apparatus of the electrophotographic type. Further, the image forming apparatus 1 is a so-called intermediary transfer and tandem type image forming apparatus in which image forming portions 2 for four colors of yellow (Y), magenta (M), cyan (C) and black (Bk) are disposed side by side on an intermediary transfer belt 3 as an image bearing member. Such an image forming apparatus has gone mainstream in recent years from the viewpoint of excellence in thick paper compatibility and productivity. Incidentally, the image forming portions 2 are not limited to those for the above-described four colors. Further, the order of the arrangement of the image forming portions 2 for the four colors is also not limited to those described above.

Each of the image forming portions 2 is constituted by a photosensitive drum (photosensitive member) 4 as a rotatable member and an image bearing member, an exposure device 5, a developing device 6, a primary transfer device 7, a drum cleaner 8, and the like. In an image forming process in such an image forming portion 2, first, the surface of the photosensitive drum 4 is electrically charged uniformly by a charging means such as a corona charger omitted from illustration. Next, with respect to the photosensitive drum 5 rotating in a direction indicated by an arrow m in FIG. 1, the exposure device 5 is driven on the basis of a sent signal for image information to emit light through a diffraction means 9 and the like as desired, so that an electrostatic latent image is formed on the surface of the photosensitive drum 4. The thus formed electrostatic latent image on the photosensitive drum 4 is developed by the developing device 6, thus being visualized as a toner image. Thereafter, by the primary transfer device (transfer roller) 7, a predetermined urging (pressing) force and electrostatic load bias is applied, so that the resultant toner images are successively transferred onto the intermediary transfer belt 3 to form a full-color toner image. After this transfer, transfer residual toner slightly remaining on the photosensitive drum 4 is collected by the drum cleaner 8 and thus the photosensitive drum 4 prepares for subsequent image formation. The toner image transferred on the intermediary transfer belt 3 is transferred onto the recording material S at a secondary transfer portion T.

The intermediary transfer belt 3 is an endless belt which is stretched by a driving roller 10, a follower stretching roller 11 and an inner secondary transfer roller 12 which are a rotatable member, and which is conveyed and driven in a direction indicated by an arrow n in FIG. 1. Further, the follower stretching roller 11 functions as a tension roller for applying predetermined tension to the intermediary transfer belt 3 and as a steering roller for controlling lateral deviation of the intermediary transfer belt 3 in combination. The respective color image forming processes processed in parallel by the respective image forming portions as described above are performed with timing so that the toner images are successively superposed on the toner image, which has been primary-transferred onto the intermediary transfer belt 3, from an upstream side. As a result, finally all the toner images for the full-color toner image are formed on the intermediary transfer belt 3 and are sent to the secondary transfer portion T. Then, as described above, the toner images on the intermediary transfer belt 3 are transferred onto the recording material S conveyed to the secondary transfer portion T by a conveying process described later.

The conveying process of the recording material S is performed in the following manner. The recording material S is accommodated on a lift-up device 14 in an accommodating container 13 in a stacked manner and is fed by a sheet feeding means 15 while being timed to the image formation. Here, the sheet feeding means 15 may be of a type utilizing friction separation by a sheet feeding roller or the like or of a type utilizing separation attraction with air but in this embodiment shown in FIG. 1, a structure with air is used. The recording material S fed by the sheet feeding means 15 passes through a conveying path 16*a* of a conveying unit 16 and is conveyed to a registration device 17. After oblique movement correction and timing correction of the recording material S are made in the registration device 17, the recording material S is sent to the secondary transfer portion T. The secondary transfer portion T is a toner image transfer nip, created between the inner secondary transfer roller 12 and an outer secondary transfer roller 18 which oppose each other, in which the toner image is transferred and attracted onto the recording material S as described above by applying the predetermined urging force and electrostatic load bias.

In this way, after the full-color toner image is transferred onto the recording material S at the secondary transfer portion T, the recording material S is conveyed to a fixing device 20 by a conveying portion 19 disposed in front of the fixing device 20. The fixing device may have various constitutions and types including a combination of rollers, a combination of belts, a combination of the roller and the belt, a constitution or type using a halogen heater as a heat source and a constitution or type using IH (electromagnetic induction heating). In this embodiment shown in FIG. 1, the fixing device 20 is of the type in which predetermined pressing force and heat quantity are applied onto the toner image in a fixing nip created between a fixing roller 21 and a pressing roller 22 to melt-fix the toner image on the recording material S. The thus obtained recording material S on which the fixed image is formed is subjected to feeding path selection whether the recording material S is discharged onto a sheet discharge tray 24 as it is or the recording material S is conveyed to a reverse conveying device 25 in the case where both-side image formation is required. In the case where the both-side image formation is required, the recording material S sent to the reverse conveying device 25 is subjected to a switch-back operation to interchange its leading and trailing ends and then is conveyed to a conveying device 26 for the both-side image formation. Thereafter, the recording material S is timed to a recording material for a subsequent job to be conveyed from the accommodating container 13 and passes through a sheet re-feeding path 16*b* of the conveying unit 16, thus being similarly sent to the secondary transfer portion T. The image forming process on the back surface (second surface) is similar to that in the case of the above-described surface (first surface).

Figure 2:
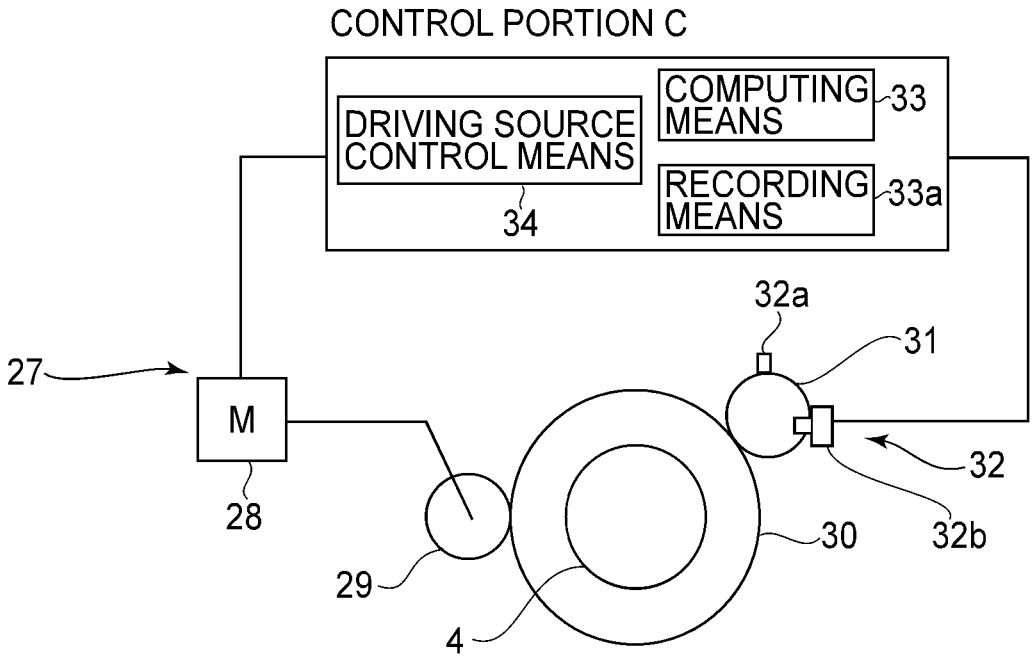
FIG. 2 is a schematic view of a driving device in First Embodiment.
Figure 3:
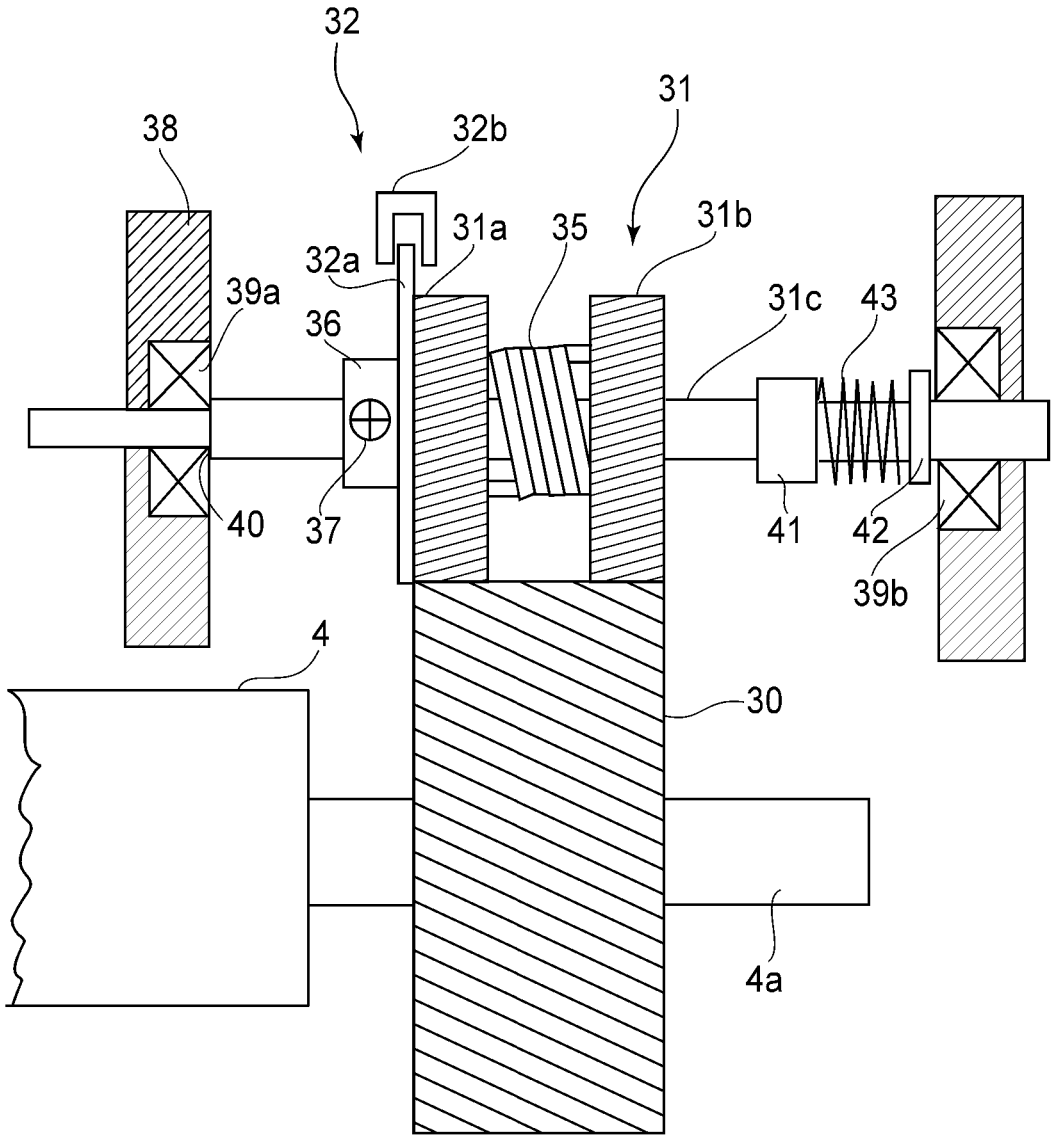
FIG. 3 is a schematic view of the driving device which is partly cut and as seen from a side direction of FIG. 2.

The above-described photosensitive drum 4 or the driving roller 10 for the intermediary transfer belt 3 is driven by a driving device 27 as shown in FIGS. 2 and 3. In the following description, the driving device 27 for the photosensitive drum 4 will be described but a device for driving the driving roller 10 is similar to the driving device 27 for the photosensitive drum 4. The driving device 27 includes a motor 28 as a driving source, a driving gear 29, a photosensitive member gear 30 as a rotatable gear, a follower gear 31, a rotation detecting means 32, a computing portion 33, a recording portion 33*a* and a driving source control portion 34. Of these, the driving gear 29 is fixed on a rotation shaft of the motor 28. Further, the photosensitive member gear 30 is fixed on a rotation shaft 4*a* of the photosensitive drum 4 and engages with the driving gear 29. The photosensitive member gear 30 has a large number of teeth than that of the driving gear 29 and is rotated at a lower speed than that of the driving gear 29. Further, each of the driving gear 29 and the photosensitive member gear 30 is a helical gear formed of a synthetic resin material. Incidentally, these gears 29 and 30 may be formed of a metallic material such as stainless steel having rigidity higher than that of the synthetic resin material and may also be a spot gear. However, when the helical gear is used, compared with the spur gear, an engaging (gearing) ratio can be made higher, so that a transmission error can be decreased.

Figure 9:
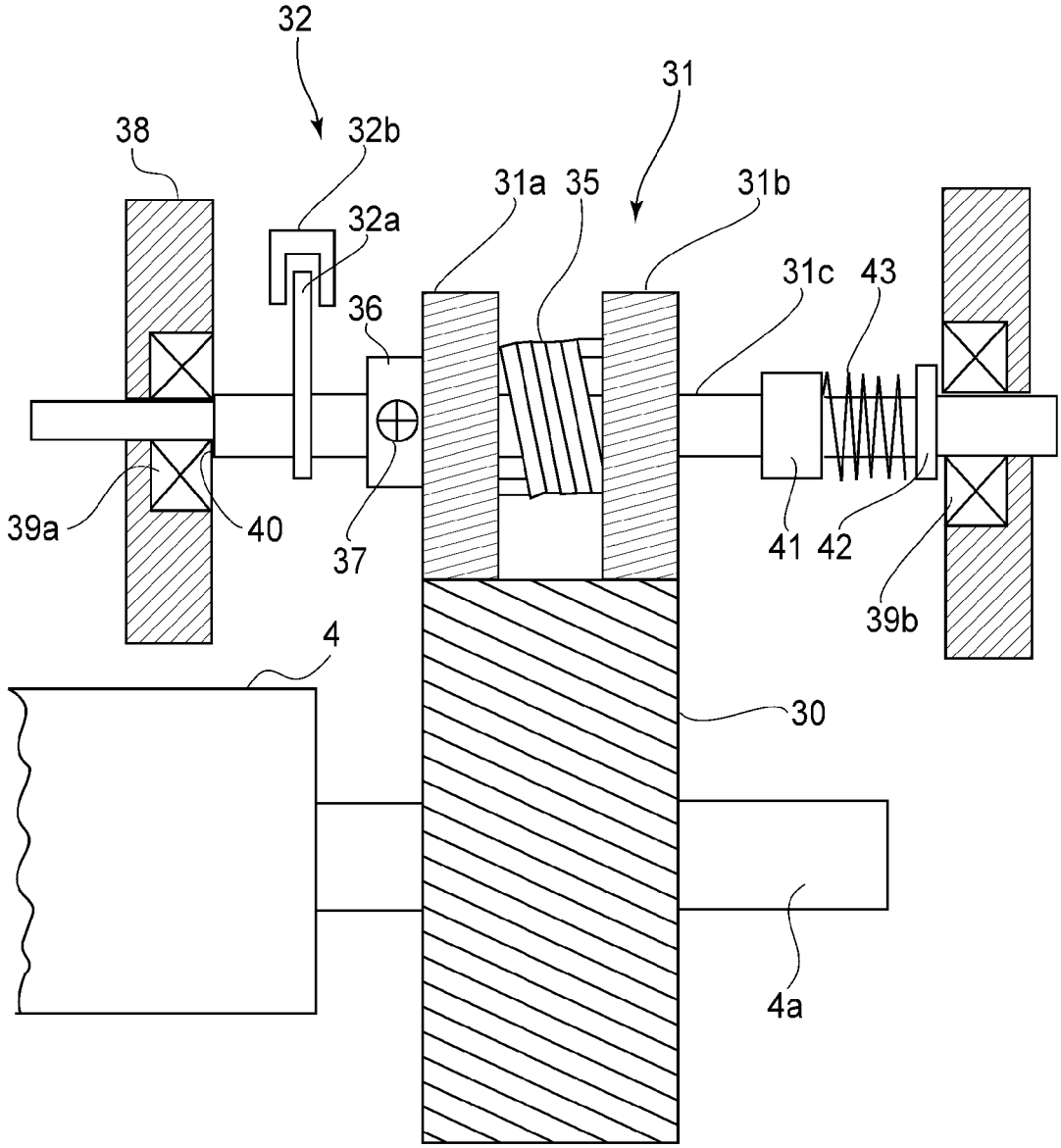
FIG. 9 is a schematic view showing an example of a structure in which a fag mounting position is changed.

The follower gear 31 includes a pair of gears 31*a* and 31*b* which are coaxially disposed with each other and includes an urging means 35 disposed between these gears 31*a* and 31*b*. These gears 31*a* and 31*b* are the helical gear formed of the synthetic resin material similarly as in the case of the driving gear 29 and the photosensitive member gear 30 and have the same specifications such as the same diameter and the same number of teeth. The number of teeth of the gears 31*a* and 31*b* is smaller than that of the photosensitive member gear 30. Incidentally, both of the gears 31*a* and 31*b* may be formed of the metallic material and may also be the spur gear. In FIG. 3 and FIGS. 3 and 9 described later, a hatched line indicated in each of the gears schematically illustrates the teeth of the gears and a direction of the hatched line represents the direction of the teeth of each gear.

Further, a teeth number ratio between the photosensitive member gear and each of the gears 31*a* and 31*b* is a non-integer. That is, the number of teeth of the photosensitive member gear 30 is a non-integral multiple of that of the follower gear 31 (each of the gears 31*a* and 31*b*). The teeth number ratio may also be integer but the number of teeth of the photosensitive member gear 30 is the non-integral multiple of that of the follower gear 31 from the viewpoint of data amount (volume) as described later. On the other hand, the teeth ratio of the follower gear 31 to the driving gear 29 is the integer. The reason for this will be also described later. Each of the gears 31*a* and 31*b* engages with the photosensitive member gear 30 and are rotated at the same rotational speed by the rotation of the photosensitive member gear 30 and is rotated at the rotational speed higher than that of the photosensitive member gear 30. Further, the urging means 35 is formed with a coil spring and is locked by the gears 31*a* and 31*b* at both end portions thereof, thus urging both of the gears 31*a* and 31*b* in mutually opposite rotational directions.

The rotation detecting means 32 detects the rotation of the follower gear 31 and a single (one) flag 32*a* rotating together with the follower gear 31 and a detecting portion 32*b* for detecting passing of this flag 32*a*. The flag 32*a* is non-rotatably fixed on one-side gear 31*a* (the left-side gear in FIG. 3) by bonding or the like and is formed as a projection projecting from the gear 31*a* in a radial direction. The flag 32*a* may also be formed integrally with the one-side gear 31*a*. Further, the detecting portion 32*b* includes a light-emitting element and a light-receiving element, e.g., as in a photo-interrupter and detects interruption of light when the flag 32*a* passes between these elements. Such a detecting portion 32*a* is supported at a fixing portion such as a frame fixed in the image forming apparatus and is disposed, e.g., so that the flag 32*a* is passable between the light-emitting element and the light-receiving element.

Further, the pair of gears 31*a* and 31*b* constituting the follower gear 31 is threadably mounted on an external thread portion formed at an intermediate portion of a rotation shaft 31*c* with respect to an axial (shaft) direction, so that each of the gears 31*a* and 31*b* is supported by the rotation shaft 31*c*. For this reason, at an inner peripheral surface of each of the gears 31*a* and 31*b*, an internal thread portion is formed. Further, a portion at which the internal thread portion of the rotation shaft 31*c* is formed extends from a stepped portion 40 formed at one-side end portion (left-side end portion in FIG. 3) of the rotation shaft 31*c* with respect to the axial direction to a portion on the other side (the right side in FIG. 3) where the gear 31*b* is to be disposed. In the case where both of the gears 31*a* and 31*b* are disposed on the rotation shaft 31*c*, these gears 31*a* and 31*b* are threadably mounted from the axial direction one-side end portion (the left-side end portion in FIG. 3) and the gear 31*b* is located at the end of the external thread portion. Thus, the gear 31*b* is prevented from further moving toward the other side (the right side in FIG. 3) with respect to the axial direction. Incidentally, the prevention of movement of the gear 31*b* with respect to the axial direction position may also be realized by providingearib at a position corresponding to a portion at which the above-described external thread portion is ended.

Further, the rotational direction in which the gears 31*a* and 31*b* are to be threadably mounted on the rotation shaft 31*c* coincides with a direction in which these gears 31*a* and 31*b* are rotated by the rotation of the photosensitive member gear 30. An inclination direction of the teeth of each of the gears is regulated so that a force exerted on the gears 31*a* and 31*b* by engagement with the photosensitive member 30 with respect to a thrust direction is directed toward the other side with respect to the axial direction. As a result, the force is exerted, in a direction in which jerky of the other side gear 31*b* relative to the rotation shaft 31*c* is prevented, by rotation transmission from the photosensitive member gear 30.

On the other hand, the one-side gear 31*a* is fixed on the rotation shaft 31*c*, in a state in which the gear 31*a* is non-rotatable around the rotation shaft 31*c* and axial direction displacement thereof is prevented, by fixing a boss portion 36 which is fixed on or integrally provided with the gear 31*a* with a screw 37. Incidentally, the other side gear 31*b* is rotatable about the rotation shaft 31*c* in the direction toward the axial direction one side (the left side in FIG. 3). Therefore, the urging means 35 for applying the urging force to each of the gears 31*a* and 31*b* in the rotational direction applies the urging force to the gear 31*b* in the direction in which the gear 31*b* is moved toward the axial direction one side and applies the urging force to the gear 31*a* in the direction in which the gear 31*a* is moved toward the axial direction the other side (the right side in FIG. 3). That is, both of the gears 31*a* and 31*b* are urged by the urging means 35 so as to be rotated in the direction in which these gears 31*a* and 31*b* more close to each other on the basis of the threadable mounting thereof on the rotation shaft 31*c*. Thus, both of the gears 31*a* and 31*b* are urged in the direction in which these gears 31*a* and 31*b* are rotated in the opposite directions to sandwich (pinch) the tooth (teeth) of the photosensitive member gear 30 between the teeth of these gears 31*a* and 31*b* (scissors gear), so that backlash the photosensitive member gear 30 and the gears 31*a* and 31*b* is eliminated.

The reason that the photosensitive member gear 30 is sandwiched by the scissors gear (sandwiched between the gears 31*a* and 31*b*) will be described. First, only by rotating the follower gear 31 simply by the rotation of the photosensitive member gear 30, the follower gear 31 is rotated in a non-load state. In the case where a structure in which the gears are simply engaged with each other is used as the transmission mechanism, the backlash is always present. Here, in the case where the rotation transmission direction is constant, when a load is present to some extent, the teeth surfaces of the gears on one side abut with each other along the rotational direction to transmit the rotational driving force. However, in the case where there is no load on the follower gear 31, even when the rotational direction is constant, the gears vibrate within the range of the backlash. Further, when the respective gears are formed of the resin material or the like, there is a possibility that the vibration is caused due to variation of a tooth surface state. Therefore, in the case where the rotation of the follower gear 31 is detected in such a structure, the detection includes a rotation detection error. In order to obviate this problem, e.g., a method in which some degree of load such as braking is applied to the follower gear may be employed but does not essentially eliminate the backlash itself. Further, in this method, a torque necessary to drive the photosensitive drum 4 is increased, so that the motor as the driving source is increased in size. Further, a force with respect to a tangential direction due to the load on the follower gear 31 is applied to the photosensitive member gear 30 but when there is variation in amount of bending of the teeth engaging those of the follower gear 31 due to the shape of the rib or the like of the photosensitive member gear 30, an angular speed of the follower gear 31 is changed and therefore an error in detection accuracy occurs.

On the other hand, in this embodiment, the photosensitive member gear 30 is sandwiched by the scissors gear, i.e., sandwiched between the gears 31*a* and 31*b* constituting the follower gear 31 as described above, so that the above-described problem can be prevented from occurring. That is, the both of the gears 31*a* and 31*b* are urged by the urging means 35 in the mutually opposite rotational directions, so that the teeth of these gears 31*a* and 31*b* pinch the tooth (teeth) of the photosensitive member gear 30 and therefore the backlash can be eliminated. Further, even when each of the gears is formed of the resin material or the like, the variation in tooth surface can be rectified. Further, in the case where the brake or the like is provided, an unnecessary force acting on the photosensitive member gear 30 with respect to the tangential direction is not exerted. As a result, it is possible to decrease only the transmission error between the photosensitive member gear 30 and the follower gear 31.

The rotation shaft 31*c* is rotatably supported by the frame 32 fixed in the image forming apparatus through bearings 39*a* and 39*b* such as a rolling bearing or a sliding bearing. Further, the stepped portion 40 provided at the one-side end portion of the rotation shaft 31*c* is caused to about against the bearing 39*a*, so that axial direction displacement of the rotation shaft 31*c* toward the one side is prevented. On the other hand, at a portion close to the other end portion (the right-side end portion in FIG. 3), a cylindrical abutment portion 41 is fixed or integrally formed and a spring 43 is disposed between the cylindrical abutment portion 41 and the bearing 39*b* through a washer 42. By the spring 43, the rotation shaft 31*c* is urged toward the above-described one side through the cylindrical abutment portion 41, so that the jerky of the rotation shaft 31*c* with respect to the axial direction is prevented. Further, the spring 43 urges the rotation shaft 31*c* by the urging force which is larger than a thrust direction force acting on the gears 31*a* and 31*b* by the engagement with the photosensitive member gear 30, so that the axial direction displacement of the gears 31*a* and 31*b* relative to the photosensitive member gear 30 is prevented. Further, the rotation shaft 31*c* is urged toward the axial direction one side, so that it is possible to suppress the jerky between each teeth of the photosensitive member gear 30 and an associated tooth of each of the gears 31*a* and 31*b*. As a result, in combination with the above-described effect of eliminating the backlash by the urging means 35 (the effect of the scissors gear), it is possible to prevent the jerky between the photosensitive member gear 30 and the gears 31*a* and 31*b* (the follower gear 31) with reliability. Incidentally, there is need to enhance processing (machining) accuracy or mounting accuracy of the respective parts but the rotation shaft 31*c* may also be supported in the state in which the axial direction displacement of the frame 38 is prevented without using the spring 43, different from the above-described manner.

Figure 4:
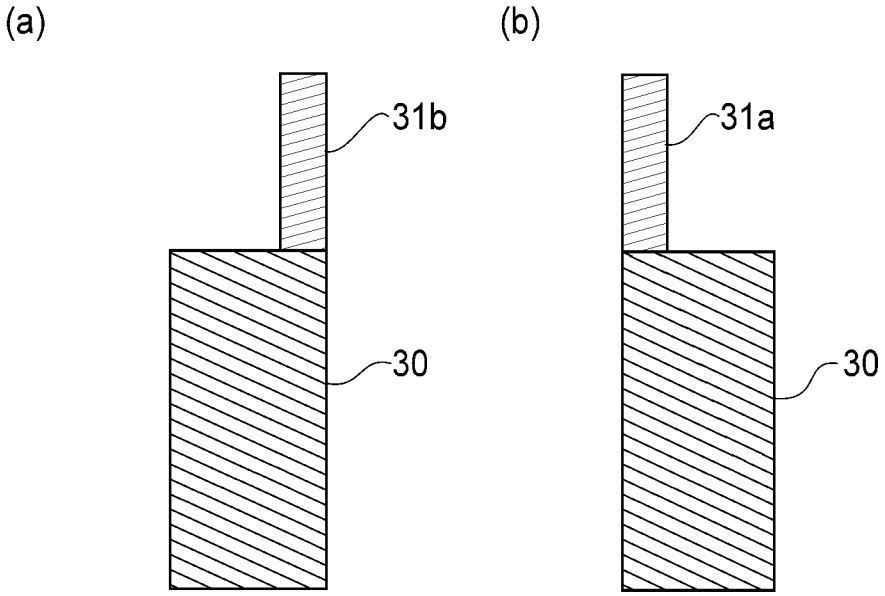
FIGS. 4(*a*) and 4(*b*) are schematic views, of separated state of a pair of gears constituting a follower gear, for illustrating an engagement state in which an associated one of the portion gears is engaged with a photosensitive member gear.

The reason for preventing the axial direction displacement of the gears 31*a* and 31*b* described above will be explained more specifically. First, the pair of gears 31*a* and 31*b* constituting the follower gear 31 is formed with the helical gear and due to the presence of a twist (helix) angle in the helical gear, two features are provided. One (first) feature is such that when the gears 31*a* and 31*b* engaging the photosensitive member gear 30 are disposed at different positions relative to the photosensitive member gear with respect to the thrust direction, phases thereof with respect to the rotational direction are also different from each other. That is, as shown in FIGS. 4(*a*) and 4(*b*), assuming that the photosensitive member gear 30 is in the same phase, the gear 31*b* in a state of FIG. 4(*a*) and the gear 31*a* in a state of FIG. 4(*b*) are different in phase from each other with respect to the rotational direction.

The other (second) feature is, as described above, such that the force applied from the photosensitive member gear 30 to the gears 31*a* and 31*b* is divided into not only a rotational direction component but also a sinusoidal component and acts also in the thrust direction (the axial direction) along the twist angle direction. For example, in the case where the transmission error is decreased by performing the rotation transmission while applying the load such as braking to the rotating gears 31*a* and 31*b*, the force is applied to the tooth surface in a certain direction and the thrust direction is also constant, so that it is possible to easily regulate the force applied in the thrust direction. On the other hand, in this embodiment, the constitution in which the transmission error is decreased by the scissors gear without using the braking or the like is employed, so that the direction of the force acting in the thrust direction is changed depending on an increased or decreased speed of the photosensitive member gear 30. Further, in the case of this embodiment, the follower gear 31 is increased in speed relative to the photosensitive member gear 30 and rotational inertia of the follower gear 31 relative to the photosensitive member gear 30 generally has an effect which is the square of the speed increasing ratio, so that the follower gear 31 has the rotational inertia to some extent. As a result, the force acting in the thrust direction is increased.

As described above, in the case of this embodiment, the follower gear 31 is use din the form of the scissors gear with respect to the photosensitive member gear 30 and is rotated at the speed higher than that of the photosensitive member gear 30, so that the direction of the force acting in the thrust direction is changed each time depending on the increased or decreased speed of the photosensitive member gear 30 and the force is increased. Therefore, the gears 31*a* and 31*b* constituting the follower gear 31 are moved in the thrust direction when the gears 31*a* and 31*b* are simply used as the scissors gear. As described above, when the gears 31*a* and 31*b* are moved in the thrust direction, each of the rotational direction phases of the gears 31*a* and 31*b* is also changed. As a result, even when the rotation detection is performed by the flag 32*a* rotating together with the gear 31*a*, due to such a change in phase, a detection error is caused to occur. On the other hand, in this embodiment, the movement of the gears 31*a* and 31*b* in the thrust direction is prevented as described above, so that the occurrence of such a detection error can be prevented to improve the detection accuracy.

In a control portion C incorporated into or provided separately from a control device for controlling the entire image forming apparatus, the computing portion 33, the recording portion 33*a* and the driving source control portion 34 are provided. Of these portions, the computing portion 33 is constituted as described above and computes (calculates) rotation fluctuation of the photosensitive member gear 30 as described later from a signal, on the basis of the rotation of the photosensitive member gear 30, detected by the detecting portion 32*b*. Further, the recording portion 33*a* records (stores) data detected by the detecting portion in order to perform such a computation. However, the recording portion 33*a* may be omitted depending on a computing method of the computing portion 33. Further, the driving source control portion 34 controls the motor 28 on the basis of a result of the computation of the computing portion 33.

Control effected on the basis of the data detected by the detecting portion 32*b* in the above-described manner will be described more specifically. First, in this embodiment, the follower gear 31 is rotated at the speed higher than that of the photosensitive member gear 30, so that it is possible to obtain the number of measuring points (the number of passing of the flag 32*a*) correspondingly to the speed increasing ratio through one full turn of the photosensitive member gear 30. Incidentally, in this embodiment, the speed increasing ratio is the non-integer, so that the data amount can be increased as described later but the number of measuring points necessary to extract rotational speed non-uniformity may only be required to be ensured. Further, the gear ratio of the follower gear 31 to the photosensitive member gear 30 is the integer, so that even in the case where the eccentricity occurs in the follower gear 31, this eccentricity is always drivable by the detecting portion 32*b* in the same phase. For this reason, it is possible to eliminate an image of the eccentricity of the driving gear 29 on the data to be detected.

Figure 5:
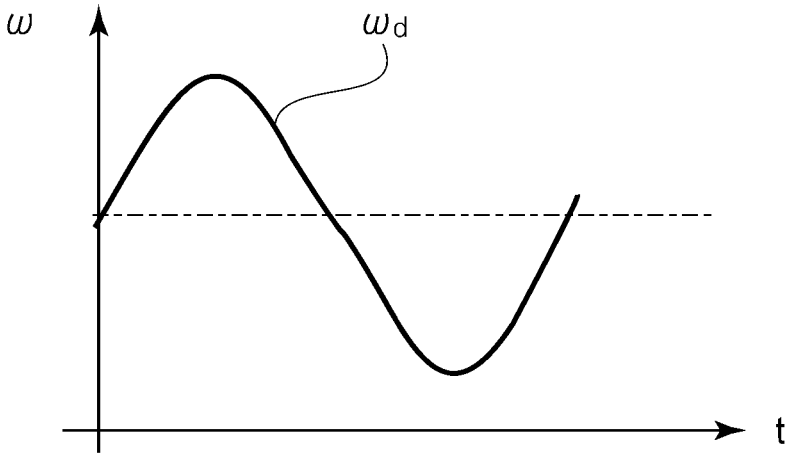
FIG. 5 is a graph showing a change in angular speed due to eccentricity of the photosensitive member gear.
Figure 6:
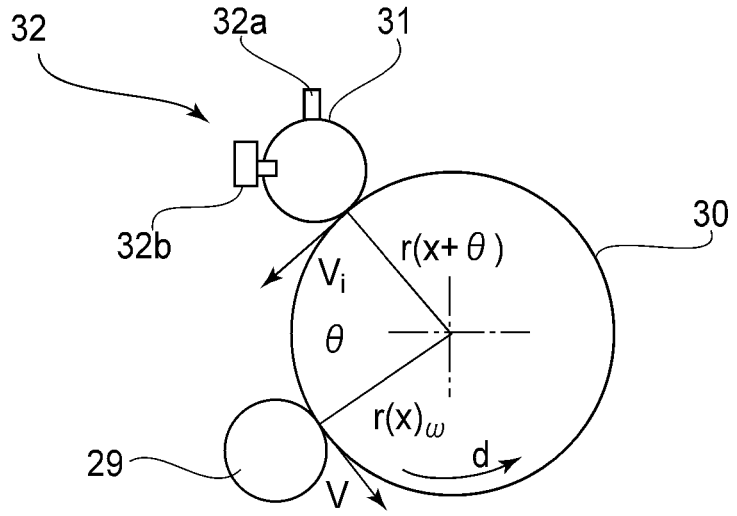
FIG. 6(*a*) is a schematic view for illustrating a relationship between a phase difference, between a driving gear and the follower gear, and a peripheral speed of a rotatable member gear at each of positions, and FIG. 6(*b*) is a graph showing a change in each of the peripheral speeds and a change in peripheral speed detected by a rotation detecting means.
Figure 6:
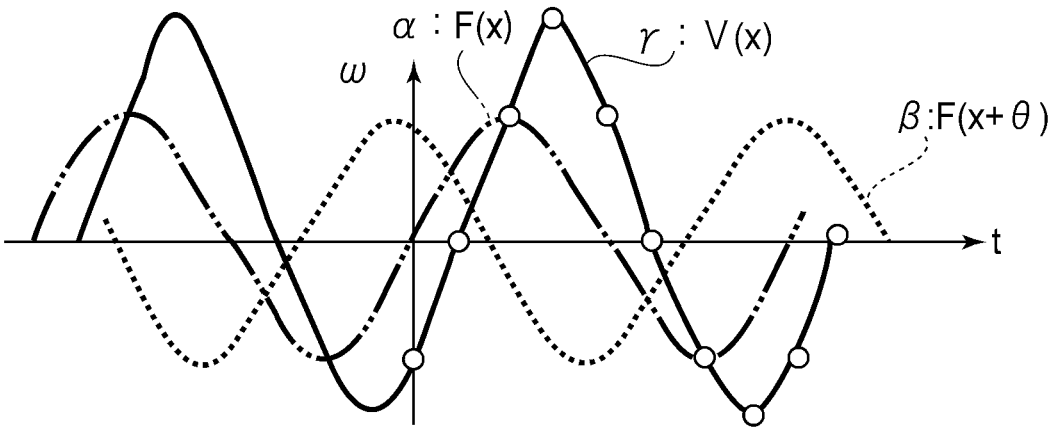

On the other hand, the data detected by the detecting portion 32*b* does not correspond to actual rotational speed non-uniformity of the photosensitive member gear 30 but corresponds to a composite wave of the rotational speed non-uniformity of the photosensitive member gear 30 and a phase difference deviation component corresponding to an angle θ formed between the driving gear 29 and the follower gear 31 with respect to the center of the photosensitive member gear 30. This will be described with reference to FIGS. 5, 6(*a*) and 6(*b*). First, the case where the photosensitive member gear 30 has a certain amount of eccentricity and the driving gear 29 is rotated ideally is assumed. In this case, an angular speed (velocity) $\omega_d$ of the recording material gear 30 varies depending on a radius r(x) since a peripheral speed v at the engaging portion of the photosensitive member gear 30 with the driving gear 29 (FIG. 6(*a*)). As a result, the rotational speed non-uniformity of the photosensitive member gear 30 is in the shape of a sinusoidal wave as shown in FIG. 5. Incidentally, a broken line in FIG. 5 represents the angular speed (target value) in the case where no occurrence of the rotational speed non-uniformity of the photosensitive member gear 30 is assumed. On the other hand, the follower gear 31 is rotated at a peripheral speed $V_i$ influenced by the radius r(x+θ) at the mounting position and the angular speed $\omega_d$ at that time. As a result, the data detected by the detecting portion 32*b* corresponds to, as shown in FIG. 6(*b*), the composite wave (γ) of the rotational speed non-uniformity (α) of the photosensitive member gear 30 and the phase difference deviation component (β) corresponding to the angle θ formed between the driving gear 29 and the follower gear 31 with respect to the center of the photosensitive member gear 30.

Thus, the data detected by the detecting portion 32*b* corresponds to the composite wave (γ), so that there is need to extract the actual rotational speed non-uniformity of the photosensitive member gear 30 from the data. As an extracting method the actual rotational speed non-uniformity, some methods can be considered but in this embodiment, the extracting method in which multivariate analysis using Fourier series is performed is employed. First, generally, an arbitrary waveform can be represented by using the Fourier series and a general formula (equation) thereof is the following formula (1).

$$V(x)=A\sin\omega t+B\cos\omega t+C\sin 2\omega t+D\cos 2\omega t+\ldots \quad (1)$$

Further, when the waveform (composite wave γ) detected by the detecting portion 32*b* is V(x) and the actual rotational speed non-uniformity (α) of the photosensitive member gear 30 is F(x), a formula (2) shown below is satisfied. Here, θ is determined by the mounting positions of the driving gear 29 and the follower gear 31, so that F(x) which is the actual rotational speed non-uniformity of the photosensitive member gear 30 can be obtained from the formula (2) when V(x) can be obtained.

$$V(x)=F(x)-F(x+\theta) \quad (2)$$

Here, the rotational speed non-uniformity of the photosensitive member gear 30 is caused by the eccentricity or the tilting during the mounting and corresponds to a waveform substantially close to a first-degree sinusoidal wave. For this reason, V(x) can be derived by obtaining coefficients A and B since the formula (1) is represented by the following formula (3).

$$V(x)=A\sin\omega t+B\cos\omega t \quad (3)$$

A method of obtaining the coefficients A and B will be described below. The number of the angular speed data obtained by the detecting portion 32*b* when the photosensitive member gear 30 rotates one full circumference is taken as n. Here, with respect to n pieces of the angular speed data, in the case where the speed increasing ratio of the follower gear 31 to the photosensitive member gear 30 is the integer, the value of n is maximum at the speed increasing ratio, so that only the measuring data corresponding to the one full circumference of the photosensitive member gear 30 can be obtained. On the other hand, in this embodiment, in the case where the speed increasing ratio is the non-integer, a maximum of the value of n varying depending on the number of rotation of the photosensitive member gear 30 is a value when "(speed increasing ratio)×(number of rotation of photosensitive member gear 30)" is the integer. In this case, the resultant respective values of the angular speed V(x) are represented by the following formula (4).

$$V(1)=A\sin\omega t_1+B\cos\omega t_1$$

$$V(2)=A\sin\omega t_2+B\cos\omega t_2$$

$$V(3)=A\sin\omega t_3+B\cos\omega t_3$$

$$\ldots$$

$$V(n)=A\sin\omega t_n+B\cos\omega t_n \quad (4)$$

Further, the formula (4) can be complicated as a determinant represented by the following formula (5).

$$\begin{pmatrix} \sin\omega t_1 & \cos\omega t_1 \\ \sin\omega t_2 & \cos\omega t_2 \\ \sin\omega t_3 & \cos\omega t_3 \\ \cdot & \cdot \\ \sin\omega t_n & \cos\omega t_n \end{pmatrix}\begin{pmatrix} A \\ B \end{pmatrix}=\begin{pmatrix} V(1) \\ V(2) \\ V(3) \\ \cdot \\ V(n) \end{pmatrix} \quad (5)$$

From the formula (5), the coefficients A and B by subjecting a matrix portion of the trigonometric function to normalization and then to inverse matrix calculation. When the coefficients A and B are obtained, as described above, V(x) is obtained by the formula (3). When V(x) is obtained, the formula (2) is an identical equation (identity) by assuming that F(x) is an arbitrary first-order trigonometric function, so that F(x) is obtained. In this embodiment, the above-described n pieces of the data are recorded (stored) in the recording portion 33*a*, the computation as described above is performed on the basis of the recorded data by the computing portion 33. Incidentally, when the phase difference θ between the driving gear 29 and the follower gear 31 is 180 degrees (π), the load at the computing portion 33 can be preferably decreased. That is, it is preferable that the driving gear 29 and the follower gear 31 are disposed at opposing positions in which these gears oppose each other through the center axis of the photosensitive member gear 30. As a result, F(x) is half of V(x) (F(x)=2V(x) obtained by substituting π for θ in the formula (2)), so that the load at the computing portion 33 can be decreased. Further, the change is liable to be picked up when the rotational speed non-uniformity is detected. These calculations (computations) are performed by the computing portion 33, so that F(x) is obtained as a computation result. The thus obtained F(x) is the rotational speed non-uniformity of the photosensitive member gear 30, so that the rotational speed non-uniformity of the photosensitive member gear 30 and by extension the rotational speed non-uniformity of the photosensitive drum 4 can be decreased.

The above flow will be described with reference to FIGS. 7(*a*) to 7(*c*). Of block diagrams shown in FIGS. 7(*a*) to 7(*c*), FIG. 7(*a*) shows the case where control of the rotational speed non-uniformity of the photosensitive member gear 30 is not effected. On the other hand, FIGS. 7(*a*) and 7(*c*) show the cases where the rotational speed non-uniformity of the photosensitive member gear 30 is detected by the rotation detecting means 32 through the follower gear 31 as described above and the photosensitive member gear 30 is subjected to feedfoward control on the basis of a result of the detection. Further, referring to FIG. 7(*b*), the rotational speed non-uniformity of the photosensitive member gear 30 is detected by the rotation (speed) detecting means 32 and the computation is performed at the computing portion 33 on the basis of the resultant data. Further, referring to FIG. 7(*c*), the motor 28 is controlled on the basis of a result of the computation and the photosensitive member gear 30 is driven. Incidentally, the feedfoward control shown in FIG. 7(*c*) is merely an example and the present invention is not limited thereto. For example, it is also possible to employ feedback control. Such control is effected with arbitrary timing but, e.g., is effected at the times of power rising of the image forming apparatus 1, rising from a sleep state, start of the job, every present period, and the like.

Next, an experiment performed for confirming an effect of this embodiment will be described. In this experiment, the number of the measuring data was 10. Further, an experimental condition was such that the number of teeth of the driving gear 29 was 18, the number of teeth of the photosensitive member gear 30 was 180, and the number of teeth of the follower gear 31 (each of the gears 31*a* and 31*b*) was 18. Each of the gears was the helical gear. The gears 31*a* and 31*b* were used as the scissors gear to sandwich the photosensitive member gear 30. Further, the target value of the number of rotation of the photosensitive member gear 30 was set at 200 rpm which was within a practical range.

Figure 7:
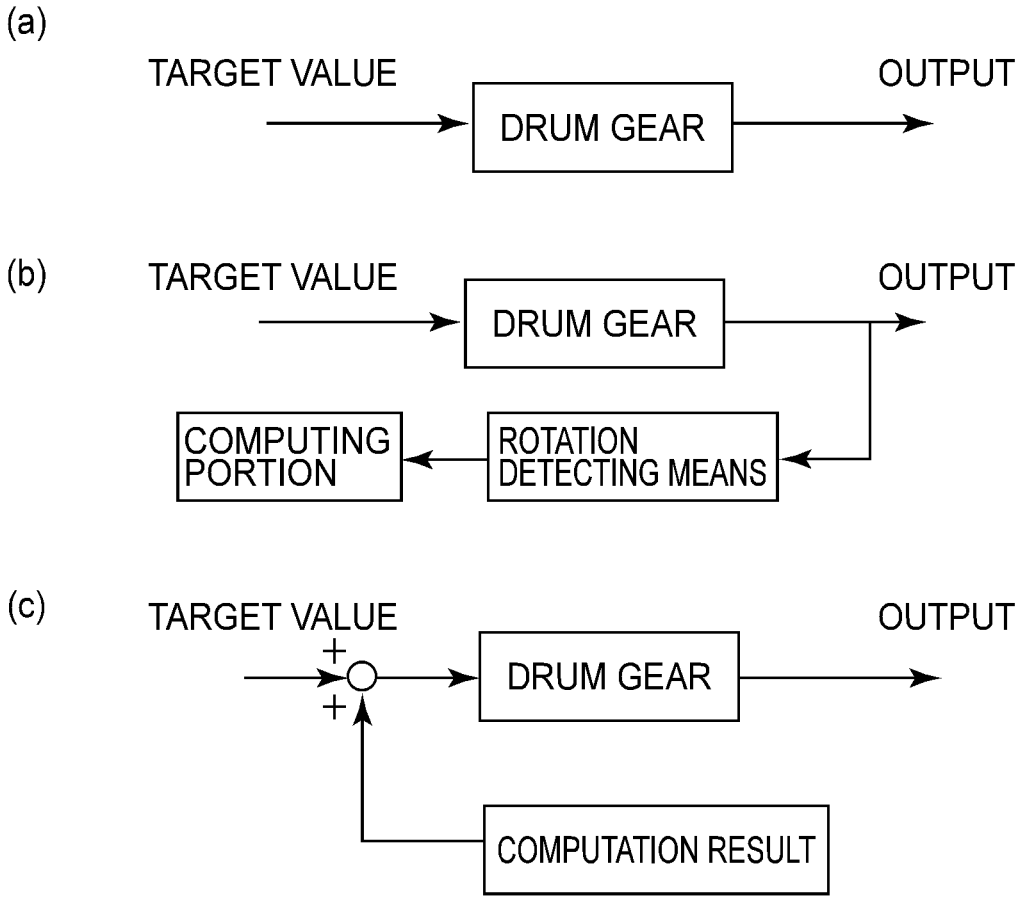
FIGS. 7(*a*) to 7(*c*) are block diagrams, wherein FIG. 7(*a*) shows the case where control for rotational speed non-uniformity is not effected, FIG. 7(*b*) shows the case where computation for effecting the control for the rotational speed non-uniformity is performed, and FIG. 7(*c*) shows the case where feed forward control for the photosensitive member gear is effected on the basis of a result of the computation.
Figure 8:
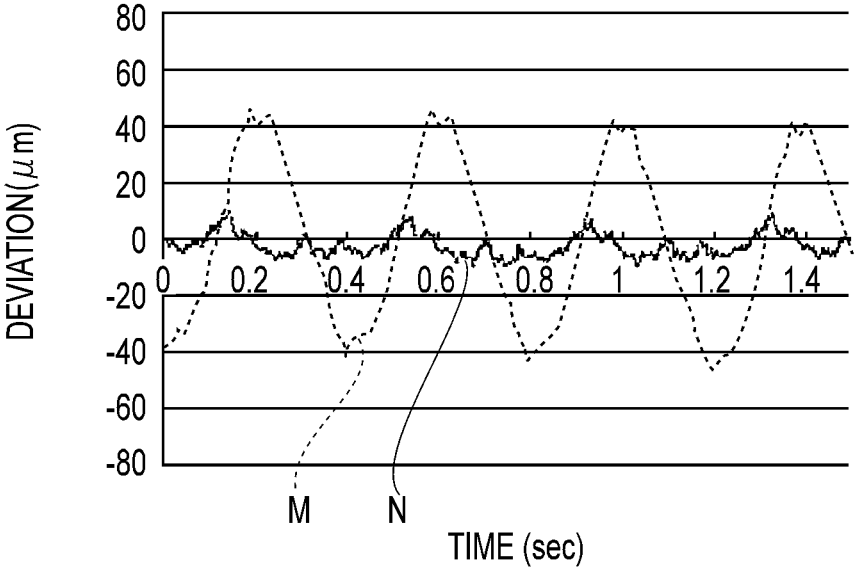
FIG. 8 is a graph showing a result of measurement of an amount of positional deviation of a photosensitive drum surface in the case where the control in First Embodiment is effected and in the case where the control in First Embodiment is not effected.

As described above, after the rotational speed non-uniformity of the photosensitive member gear 30 is obtained, from the data obtained by the detecting portion 32*b*, by the computing portion 33, in accordance with the control shown in FIG. 7(*c*), the motor 28 is drive-controlled so that a signal providing an opposite phase (antiphase) of the obtained rotational speed non-uniformity is added to the target value. Results of measurement of an amount of positional deviation occurring at the surface of the photosensitive drum 4 in the cases where such control is effected and is not effected are shown in FIG. 8. In FIG. 8, a broken line M represents the case where the control is not effected, and a solid line N represents the case where the control is effected. As a result, by employing the constitution in this embodiment, it was found that the amount of positional deviation at the surface of the photosensitive drum 4 was decreased to about ⅕.

According to this embodiment, the follower gear 31 can be formed with the pair of gears 31*a* and 31*b* as the scissors gear to sandwich the tooth of the photosensitive member gear 30 between the teeth of the gears 31*a* and 31*b*, so that the backlash can be sufficiently prevented and therefore accurate rotation detection can be performed. Further, in the case of this embodiment, the structure in which the passing of the single flag 32*a* rotating together with the follower gear 31 at the speed higher than that of the photosensitive member gear 30 is detected by the detecting portion 32*b* is used. For this reason, irrespective of the mounting accuracy and processing accuracy of the flag 32*a*, the rotation of the follower gear 31 and by extension the photosensitive drum 4 can be accurately detected. That is, in the case where the rotation of the photosensitive drum 4 is detected by a plurality of flags or the rotary encoder, the accurate rotation detection cannot be performed unless the mounting accuracy and processing accuracy of each flag or the rotary encoder is improved. On the other hand, when the single flag 32*a* is used, the accurate rotation detection can be performed in expensively irrespective of the mounting accuracy and the like, so that even when the influence of the eccentricity of each gear is changed due to the change with time of each part, it is possible to effect control correspondingly to the change. As a result, the eccentricity of each gear can be cancelled without depending on the change with time, so that the control for decreasing the rotational speed non-uniformity of the photosensitive member gear 30 and by extension the rotational speed non-uniformity of the photosensitive drum 4 can be effected with high accuracy. Thus, when the rotational speed non-uniformity of the photosensitive drum 4 can be decreased, it is possible to achieve an effect of alleviating the color misregistration in the color image forming apparatus.

Incidentally, in the above description, the rotation detection is performed by fixing or integrally providing the flag 32*a* on the gear 31*a* of the follower gear 31 but the flag 32*a* is not necessarily required to be provided on the gear 31*a*. For example, as shown in FIG. 9, in the case of a structure in which the gear 31*a* is fixed on the rotation shaft 31*c* and the rotation shaft 31*c* is not rotatable relative to the gear 31*a*, the rotation shaft 31*c* may also be provided with the flag 32*a* separately. In this case, the detecting portion 32*b* is disposed at a position correspondingly to the flag 32*a*.

Second Embodiment

Figure 10:
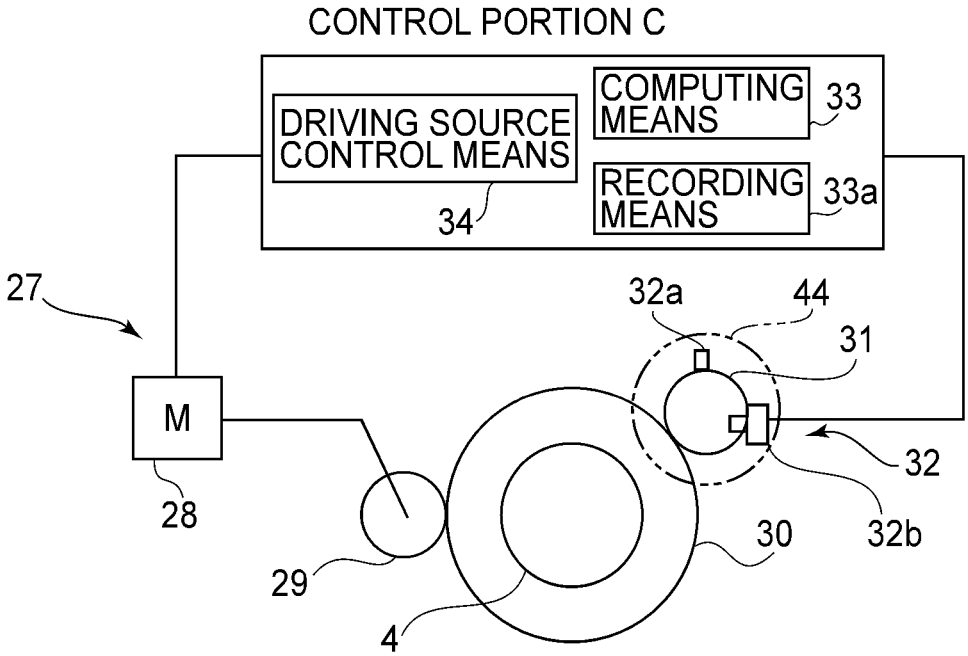
FIG. 10 is a schematic view showing a driving device in Second Embodiment.
Figure 11:
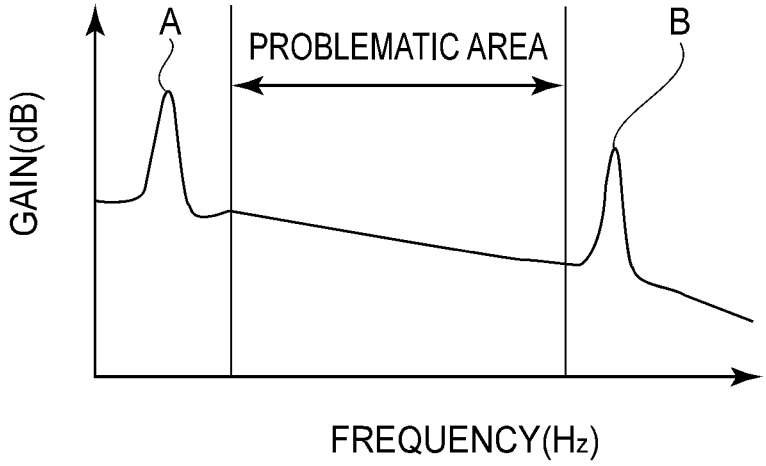
FIG. 11 is a graph showing a resonance frequency generated when a photosensitive drum in driven.

Second Embodiment of the present invention will be described with reference to FIGS. 10, 11, 12(*a*) and 12(*b*). In this embodiment, a flywheel 44 which is an inertial member is fixed on the rotation shaft 31*c* of the follower gear 31. Other constitutions and functions are similar to those in the above-described First Embodiment, thus being omitted from detailed description. Generally, it has been known that an inertial effect of the inertial member having the same weight and the same radius is achieved as the square of the rotational speed ratio. For this reason, by mounting the flywheel 44 on the follower gear 31 rotating at the speed higher than that of the photosensitive member gear 30 as in this embodiment, a sufficient inertial effect can be obtained even when the flywheel 44 has a small diameter.

Further, in this embodiment, by using the follower gear 31 as the scissors gear to sandwich the photosensitive member gear 30, rigidity of the engaging portion between the follower gear 31 and the photosensitive member gear 30 is improved, even when the gears are formed of the resin material, without using the metal-made gears. For this reason, the resonance frequency between the follower gear 31 and the photosensitive member gear 30 can be shifted to a high-frequency side as indicated by B in FIG. 11, so that a banding preventing effect is achieved. That is, a "PROPLEMATIC AREA" shown in FIG. 11 is a frequency band in which the banding is liable to occur. Therefore, in order to prevent the banding, there is need to devise constitutions of the respective portions so that the resonance frequency is deviated from the frequencies in the frequency band. One of factors for determining the resonance frequency may be the rigidity of the engaging portion. For this reason, the rigidity of the engaging portion is improved by the above-described scissors gear, so that the resonance frequency can be shifted (deviated) from the "PROBLEMATIC AREA" to the high-frequency side. Further, the resonance frequency between the photosensitive member gear 30 and the driving gear 29 can be shifted, as shown by A in FIG. 11, to a side where the frequency is lower than those in the "PROBLEMATIC AREA".

Figure 12:
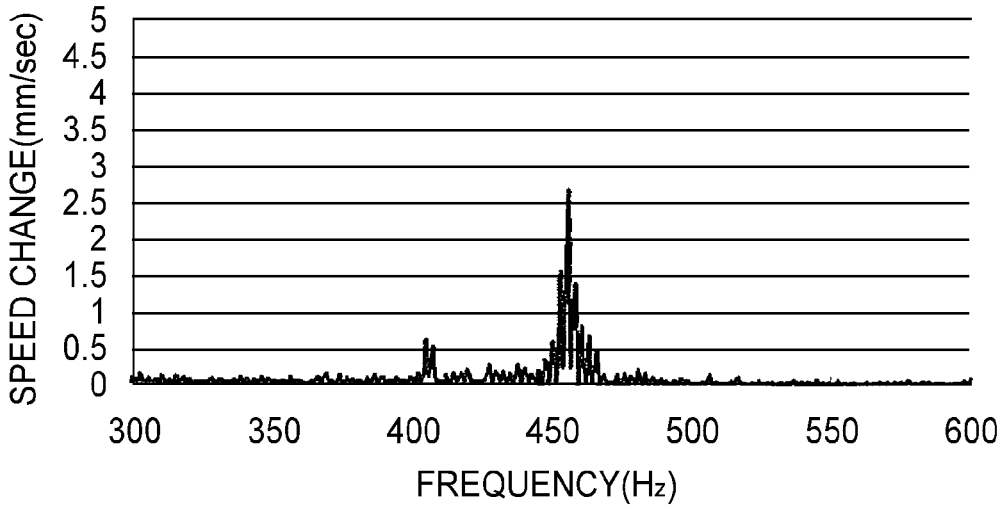
FIGS. 12(*a*) and 12(*b*) are graphs each showing a result of measurement of a magnitude of banding, wherein FIG. 12(*a*) shows the case where a structure in Second Embodiment is used, and FIG. 12(*b*) shows the case where the structure in Second Embodiment is not used.
Figure 12:
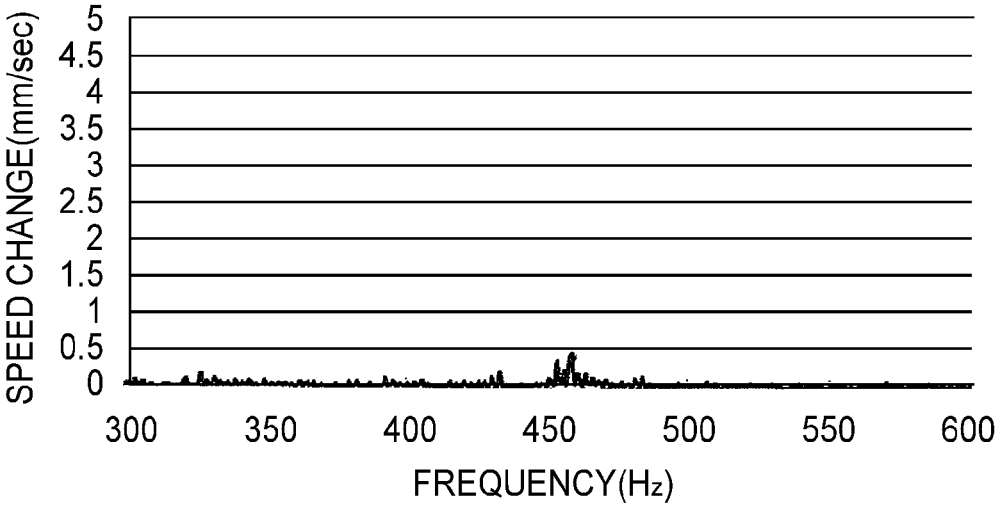

A result of an experiment conducted for confirming such an effect in this embodiment is shown in FIGS. 12(*a*) and 12(*b*). Each of FIGS. 12(*a*) and 12(*b*) shows a relationship between the speed change (fluctuation) and the frequency at the surface of the photosensitive drum 4. FIG. 12(*a*) shows the result of the experiment conducted with respect to a structure (Comparative Embodiment) in which the follower gear is not used as the scissors gear for sandwiching the photosensitive member gear 30 and the flywheel 44 is not provided on the rotation shaft of the follower gear. Further, FIG. 12(*b*) shows the result of the experiment conducted in this embodiment (Second Embodiment). Incidentally, in either of Second Embodiment and Comparative Embodiment, the experiment condition was such that the number of teeth of the driving gear was 18, the number of teeth of the member gear 30 was 180, and the number of teeth of the follower gear 31 (each of the gears 31*a* and 31*b*) was 18. Incidentally, in Comparative Embodiment, a single follower gear is used but the number of teeth thereof is equal to that in Second Embodiment. Further, as all the gears, the helical gear was used. Further, the target value of the number of rotation of the photosensitive member gear 30 was set at 200 rpm which was within the practical range. Further, the flywheel 44 employed in this embodiment had a diameter of 50 mm, a weight of 25 g and moment of inertia was 9000 g $mm^2$. As apparent from FIGS. 12(*a*) and 12(*b*), in Comparative Embodiment (FIG. 12(*a*)), the banding a occurred in the neighborhood of about 450 Hz. On the other hand, in Second Embodiment (FIG. 12(*b*)), the magnitude of the banding (the speed change) was decreased to about ⅕ of that in Comparative Embodiment.

According to this embodiment, in addition to the color misregistration decreasing effect described in First Embodiment, the inertial effect equivalent to that of a large-sized flywheel can be obtained by the small-sized flywheel without using the large-sized flywheel. Further, by using the follower gear 31 as the scissors gear to sandwich the photosensitive member gear 30 the rigidity of the engaging portion between these gears 31 and 30 can be enhanced, so that the resonance point can be moved. As a result, the decrease in degree of the banding can be realized by an inexpensive constitution.

As described above, according to the present invention, the backlash between the rotatable member gear and the follower gear rotated by the rotation of the rotatable member gear can be sufficiently prevented, so that the accurate rotation detection can be performed. Further, the passing of the single flag rotating together with the follower gear at the speed higher than that of the rotatable member gear is detected and therefore the rotation of the rotatable member can be detected irrespective of the flag mounting accuracy and the flag processing accuracy, so that the inexpensive and accurate rotation detection can be performed. Further, in this way, the accurate rotation detection can be performed irrespective of the mounting accuracy and therefore even when the influence of the eccentricity of each gear is changed due to the change with time of each part, it is possible to effect the control correspondingly to the change. As a result, the eccentricity of each gear can be cancelled irrespective of the change with time, so that the control for decreasing the rotational speed non-uniformity of the rotatable member can be effected with high accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 172472/2009 filed Jul. 23, 2009, which is hereby incorporated by reference.

What is claimed is:

1. A drive device comprising:

a drive source;

a rotatable member gear, fixed on a rotation shaft of a rotatable member, for being rotated by transmitting thereto a driving force from said driving source;

a follower gear, including a pair of gears which are coaxially disposed with each other and are rotatable at the same rotational speed by rotation of said rotatable member gear and including urging means for urging the pair of gears in rotational directions opposite from each other, for being rotated at the rotational speed higher than that of said rotatable member gear;

a rotation detecting device for detecting rotation of said follower gear, wherein the rotation detecting device includes a flag rotatable together with said follower gear and provided coaxially with said follower gear and includes a detecting portion for detecting passing of the flag; and a driving source control portion for controlling said driving source on the basis of a detection result of the rotation detecting device.

2. A device according to claim 1, wherein said rotatable member gear and said follower gear are a helical gear, and wherein displacement of the pair of gears in an axial direction with respect to said rotatable member gear is prevented.

3. A device according to claim 1, wherein a number of teeth of said rotatable member gear is a non-integral multiple of that of said follower gear.

4. A device according to claim 1, further comprising a driving gear for transmitting a driving force from said driving source to said rotatable member gear, wherein said driving gear and said follower gear are disposed at opposing positions between which a center axis of said rotatable member gear is located.

5. A device according to claim 1, wherein an inertial member is fixed on a rotation shaft of said follower gear.

6. An image forming apparatus comprising:

an image bearing member; and a driving device according to claim 1, wherein said image bearing member is a rotatable member.

* * * * *